United States Patent [19]

Pisz et al.

[11] Patent Number: 4,701,102

[45] Date of Patent: Oct. 20, 1987

[54] STATIONARY BLADE ASSEMBLY FOR A STEAM TURBINE

[75] Inventors: Frank A. Pisz, Titusville, Fla.; William S. Agliano, West Chester, Pa.

[73] Assignee: Westinghouse Electric Corp., Pittsburgh, Pa.

[21] Appl. No.: 760,385

[22] Filed: Jul. 30, 1985

[51] Int. Cl.[4] ..... F10D 9/04

[52] U.S. Cl. ..... 415/136; 415/139; 415/174

[58] Field of Search ..... 415/134, 136, 185, 189, 415/190, 139, 216–218, 170 R, 171, 174

[56] References Cited

U.S. PATENT DOCUMENTS 2,556,890 6/1951 Thorn ..... 415/136

2,772,069 11/1956 Hockert et al. ..... 415/134

3,408,048 10/1968 Scalzo ..... 415/170 R X 3,529,904 9/1970 Scalzo et al. ..... 415/136

*Primary Examiner*—Abraham Hershkovitz

*Assistant Examiner*—Joseph M. Pitko

*Attorney, Agent, or Firm*—F. J. Baehr, Jr.

[57] ABSTRACT

A stationary blade assembly with a segmented inner shroud to permit radial expansion and contraction of the blades and circumferential expansion and contraction of the shroud segments and a seal plate which fits into a circumferential groove in the shroud segments and is held therein by pinned keys which slide in kerfs in the outer edge of the seal plate and a labyrinth seal strip disposed in a circumferential groove in the inner edge of the seal plate to provide a small clearance seal not affected by thermal gradients.

2 Claims, 3 Drawing Figures

STATIONARY BLADE ASSEMBLY FOR A STEAM TURBINE

BACKGROUND OF THE INVENTION

This invention relates to stationary blade assemblies for steam turbines and more particularly to a retainer plate utilized to improve interstage sealing.

Steam turbines are made with horizontal joints allowing the top half of the outer casing or cylinder to be removed. Inner cylinders and blade rings also have a horizontal joint and the stationary blades are made in semi-circular arrays, which are joined together to form a blade diaphragm, a circular array of stationary blades or a stationary blade row. To reduce interstage leakage, there is a labyrinth seal adjacent the rotor.

SUMMARY OF THE INVENTION

In general, a stationary blade assembly for a steam turbine, when made in accordance with this invention, comprises an arcuate bar extending generally 180°; an array of stationary airfoil-shaped blades extending radially inwardly from the arcuate bar; and a plurality of arcuate shroud segments disposed on the radially inner end of the blades. The arcuate shroud segments generally extend 180° and have a circular extending groove disposed on their radially inner side. An arcuate plate extends generally 180°. The radially outer edge of the arcuate plate is received by the groove in the shroud segments. The arcuate plate has a plurality of kerfs disposed on its radially outer edge and a plurality of keys are slidably received by the kerfs. The keys have means for holding them in the circumferential groove, whereby the arcuate plate is held in place within the groove, but is free to expand due to thermal gradients without transmitting stresses to the shroud segments and the blade assembly, while at the same time maintaining concentricity with the rotor.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 2:
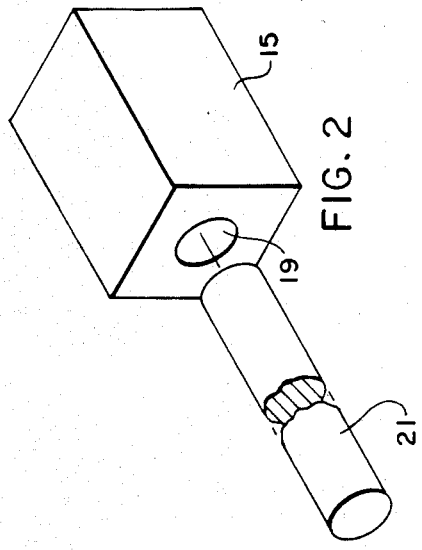
FIG. 2 is an enlarged perspective view of a key.
Figure 3:
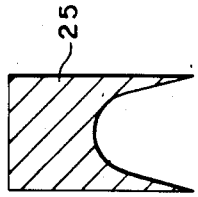
FIG. 3 is an enlarged sectional view taken on line III—III of FIG. 1.
Figure 1:
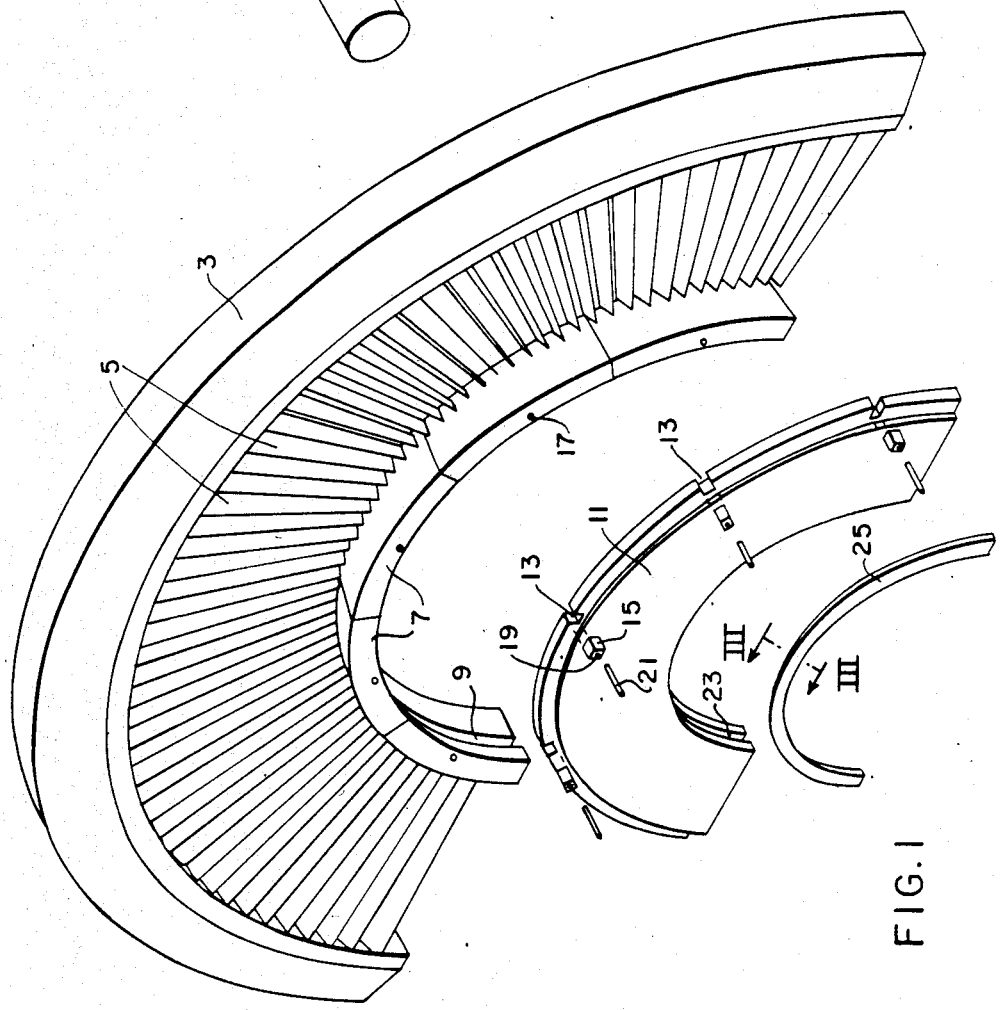
FIG. 1 is an exploded perspective view of a stationary blade assembly.

Referring now to the drawings in detail, there is shown a stationary blade assembly which is one-half of a row of stationary blades for a steam turbine (not shown).

The assembly comprises an arcuate bar 3 generally extending 180° and forming the radially outer support of the assembly, an array of stationary airfoil-shaped blades 5 extending radially inwardly from the arcuate bar 3, and a plurality of arcuate shroud segments 7 are disposed on the radially inner ends of the blades 5. The arcuate shroud segments 7 generally extend 180° and have a circumferentially extending groove 9 disposed on the radially inner side thereof.

An arcuate plate 11 extending generally 180° fits into and is received by the groove 9 in the shroud segments 7. The arcuate plate 11 has a plurality of kerfs 13 or notches disposed in its radially outer edge. A plurality of slide blocks or keys 15 are formed to be slidably received by the kerfs 13 and fit within the groove 9. The shroud segments 7 and keys 15 have registering holes 17 and 19, respectively, for receiving pins 21 which holds keys 15 in the groove 9 and thereby hold the arcuate plate 11 in the groove 9. The radially inner margin of the arcuate plate 11 has a circumferential groove 23 which receives a labyrinth seal strip 25 which is held therein by caulking or other means.

The stationary blade assembly hereinbefore described supports the arcuate plate 11 in such a manner to permit thermal expansion and contraction while maintaining concentric relationship among the parts and without inducting stresses in the shroud segments 7 and provides a means for supporting the labyrinth seal 25 at the inner diameter so as to be insensitive to radial movement of the inner shroud permitting reduced seal clearances all of which contribute to improved turbine performance. The arcuate plate 11 when assembled in the groove 9 in the shroud segments 7 also contributes toward maintaining alignment of the shroud segments 7 and associated blades 5, which would distort or twist under thermal and steam load, thus also contributing toward improved turbine performance.

What is claimed is:

1. A stationary blade assembly for a steam turbine having a rotor, said assembly comprising:

an arcuate bar extending generally 180°;

an array of stationary airfoil-shaped blades extending radially inwardly from the arcuate bar;

a plurality of arcuate shroud segments disposed on the radially inner end of the blades;

the arcuate shroud segments generally extending 180° and each shroud segment having a circumferentially-extending groove disposed on its radially inner side;

the grooves in each segment being aligned to generally form a continuous groove an arcuate plate extending generally 180°, the radially outer edge of the arcuate plate being received by the grooves in the shroud segments;

the arcuate plate having a plurality of kerfs disposed in its radially outer edge;

a plurality of keys slidably received by the kerfs;

pins extending into said shroud segments and through said keys for fixing the keys in the circumferential grooves in the shroud segments;

wherein the arcuate plate is held in place within the continuous groove but is free to expand due to thermal gradients without transmitting stresses to the shroud segments and the blade assembly and at the same time maintaining concentricity with the rotor.

2. A blade assembly as set forth in claim 1 and further comprising a circumferential groove in the radially inner edge of the arcuate plate and an arcuate strip disposed in the groove in the arcuate plate providing means for forming a running seal.

* * * * *